US005283724A

United States Patent [19]

Mulholland

[11] Patent Number: 5,283,724

[45] Date of Patent: Feb. 1, 1994

[54] FLASHLIGHT WITH AUXILIARY SWITCH

[76] Inventor: Thomas S. Mulholland, P.O. Box 2466, Slidell, La. 70459

[21] Appl. No.: 15,607

[22] Filed: Feb. 9, 1993

[51] Int. Cl.[5] ..... F21L 7/00

[52] U.S. Cl. ..... 362/205

[58] Field of Search ..... 362/205, 206

[56] References Cited

U.S. PATENT DOCUMENTS 2,772,407 11/1956 Nichols ..... 362/205

*Primary Examiner*—Carroll B. Dority

*Attorney, Agent, or Firm*—Michael D. Carbo

[57] ABSTRACT

A flashlight having a base portion and a face portion. A source of current in the base portion is connected to a light bulb in the face portion by a circuit containing a main switch and an auxiliary switch in series. The auxiliary switch includes a spring loaded plunger extending through the face portion and operative in response to the plunger being depressed when the face portion is placed on a solid surface.

4 Claims, 2 Drawing Sheets

FLASHLIGHT WITH AUXILIARY SWITCH

BACKGROUND OF THE INVENTION

The present invention relates to flashlights and more particularly to a flashlight having a auxiliary shut-off switch actuated by placement of the flashlight face down onto a solid surface.

Flashlights are commonly small battery-powered portable electric lights. Typically the battery or batteries are contained within a base portion which is adapted to be held in one hand or which has a handle attached thereto. The base portion usually has a main switch located on it so that a person can conveniently turn the flashlight on or off with the thumb of the hand holding the flashlight.

Flashlights also commonly have an end portion, referred to sometimes herein as a face or a face portion, which contains a light bulb or other illuminating device. Typically, the face portion is frusto-conical in shape with the smaller end attached to or protruding from a base portion. The light bulb is electrically connected to the battery power in a circuit that can be completed or broken by mechanically actuating the main switch, usually by pressing by mechanically actuating the main switch, usually by pressing a button or by moving a slide located on the base portion.

Flashlights are often used to illuminate areas not easily illuminated by fixed lighting. Often flashlights are needed only intermittently and a user sometimes places the flashlight face down on a solid surface until the flashlight is next needed. If the main switch is not actuated to turn off the flashlight to conserve the battery power during periods of non-use, then the useful working life of the battery or batteries is reduced. Also, if a user is concentrating on a work task and must reach for a flashlight that is off, the user must manually actuate the main switch to turn on the flashlight.

Accordingly, an object of this invention is to provide an improved flashlight in which the electrical circuit is interrupted when the flashlight is placed facedown onto a solid surface.

It is further object of this invention to provide a flashlight containing an auxiliary switch which is actuated to break the electrical circuit when the flashlight is placed facedown into a solid surface.

Yet another object of this invention is to provide a flashlight containing an auxiliary switch which is actuated to complete the electrical circuit when the flashlight is picked up from a facedown position while the main switch is in a closed position.

Additional objects and advantages of the invention are set forth in part in the description which follows, and in part are obvious from the description or may be learned by practice of the invention. The objects and advantages of the invention may be realized and obtained by means of the articles and apparatus disclosed in the specification and drawings and particularly pointed out in the articles an apparatus in the appended claims.

SUMMARY OF THE INVENTION

To achieve the objects, and in accordance with the purposes of the invention as broadly described herein, the improved flashlight comprises:

(a) a base portion containing a source of electrical power and adapted to be held in a hand;

(b) a face portion protruding from the base portion, the face portion containing a light bulb;

(c) an electrical circuit comprising the light bulb, a first electrical connection for connecting the light bulb through a main switch to one terminal of the power source and a second electrical connection for connecting the light bulb through an auxiliary switch to a second terminal of a power source; and (d) means for actuating the auxiliary switch during placement of the face portion onto a solid surface.

Preferably, the auxiliary switch actuating means comprises a plunger projecting from the face portion of the flashlight, the plunger being retractable into the face portion when the face portion is placed on a solid surface.

BRIEF DESCRIPTION OF THE DRAWINGS

A greater appreciation of the objects and advantages of the invention may be understood by the below set forth description taken in conjunction with the drawings, wherein.

DETAILED DESCRIPTION OF THE INVENTION

Figure 2:
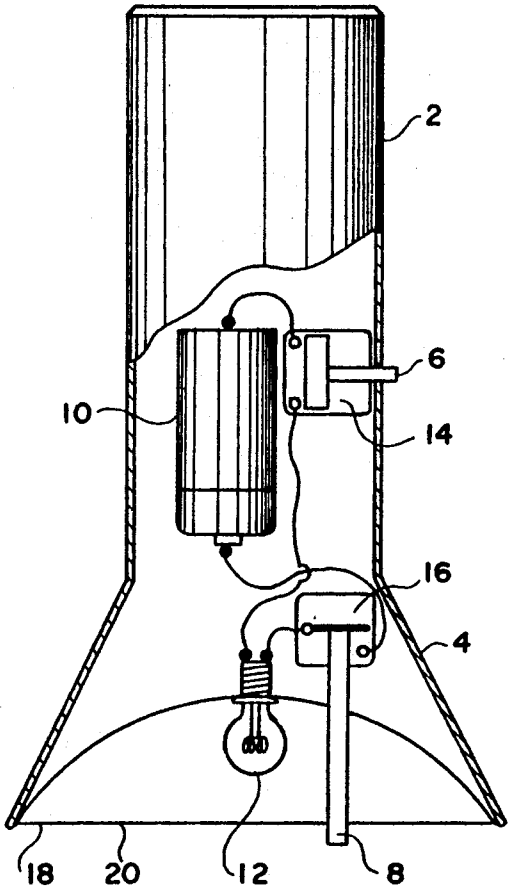
FIG. 2 is a side view of an illustrative embodiment of a flashlight according to the invention, showing an auxiliary switch actuator in a retracted position.
Figure 1:
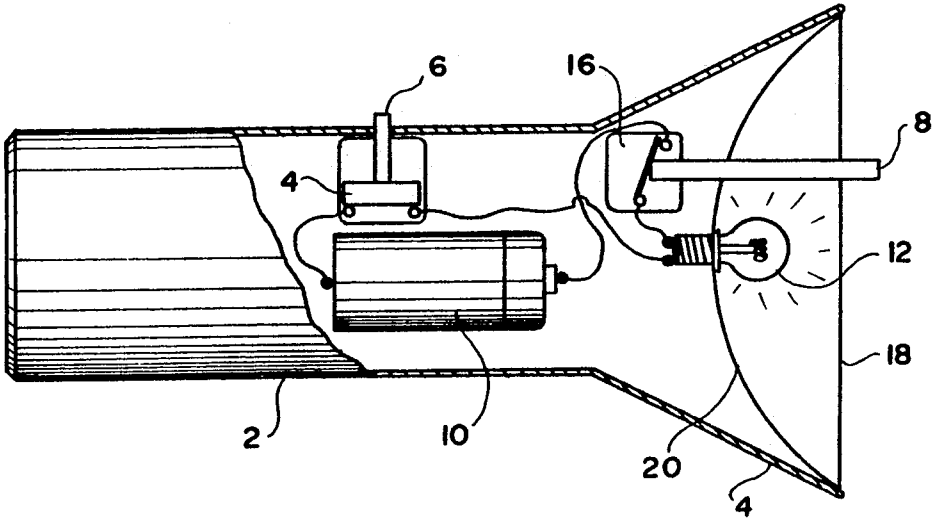
FIG. 1 is a side view of an illustrative embodiment of a flashlight according to the invention, showing an auxiliary switch actuator in an extended position.

FIGS. 1 and 2 show a side view of a flashlight having an auxiliary switch. The flashlight includes base portion 2, face portion 4, main switch actuator 6 and auxiliary switch actuator 8. Base portion 2 is preferably a hollow cylindrical tube adapted to receive battery 10 as a source of electrical power. Face portion 4 is attached to one end of base portion 2 and contains light bulb 12 electrically connected by electrical conductors through main switch 14 to one end of battery 10 and through auxiliary switch 16 to the other end of battery 10. When both main switch 14 and auxiliary switch 16 are in a closed position, battery 10 and bulb 12 are connected in a circuit and bulb 12 emits light. If main switch 14 is switched to an open position, the circuit is broken and bulb 12 does not emit light.

Preferably, main switch 14 is a bistable plunger-actuated switch positioned within base portion 2 so that repeatedly depressing main switch actuator 6 sequentially opens and closes the electric circuit at main switch 14. Preferably, main switch 14 is a normally open switch, although it can be a normally closed switch.

Face portion 4 preferably protrudes from one end of base portion 2. Alternatively, face portion 4 is attached to base portion 2 by means of a screw-type connection so that face portion 4 and base portion 2 can be disconnected to allow batteries to be removed or inserted and to allow bulb 12 to be removed or inserted.

Figure 3:
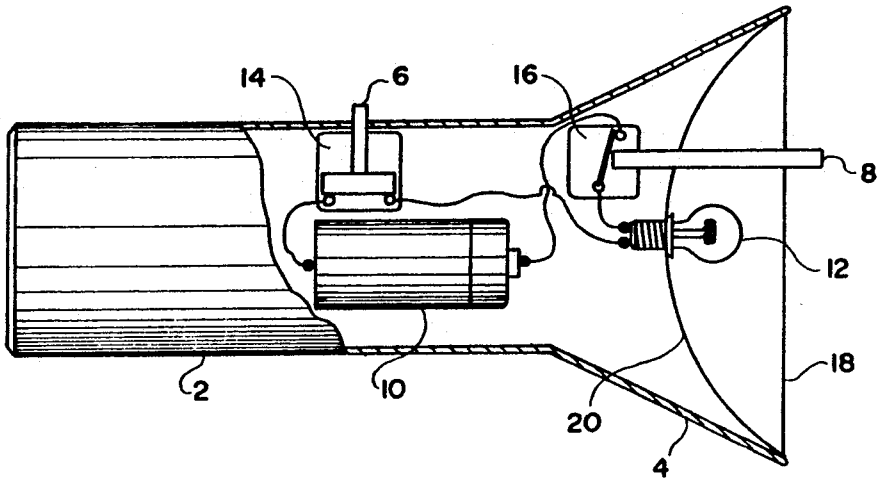
FIG. 3 is a view taken on lines 1—1 on FIG. 1.

Face portion 4 is preferably frusto-conical in shape, is connected at its smaller end to base portion 2 and has at its larger end translucent surface 18 which allows light from bulb 12 to shine through. As shown best in FIG. 3, within face portion 4 is preferably contained reflective surface 20 that reflects light directed onto it to effectively allow more light from bulb 12 through translucent surface 18. Relective surface 20 or translucent surface 18, or both, can be shaped so that light from bulb 12 is focused at a predetermined distance from the end of the flashlight.

Figure 4:
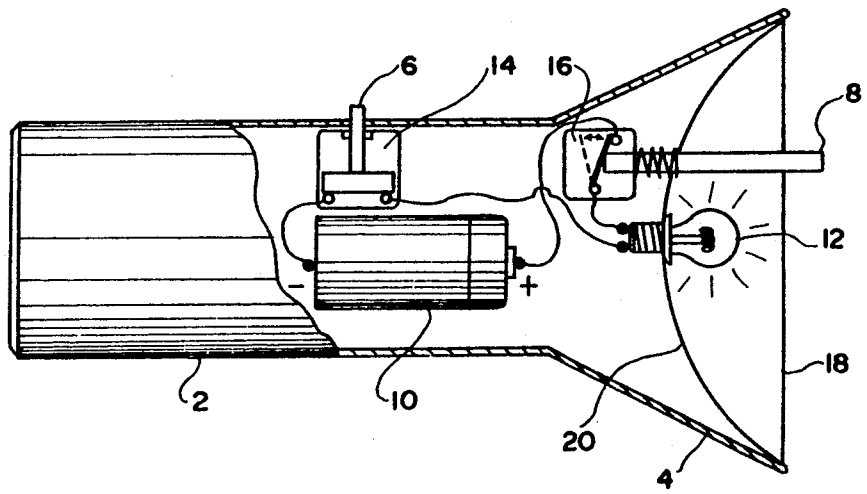
FIG. 4 is a schematic view of an illustrative embodiment of a flashlight according to the invention showing an illustrative electrical circuit contained within the body portions of the flashlight.

Face portion 4 preferably contains auxiliary switch 16 electrically connected by electrical conductors between bulb 12 and an end of battery 10. FIG. 4 shows in schematic form an electrical circuit including battery 10 as a power supply, main switch 14 connected to the negative terminal of battery 10, light bulb 12 connected in series to main switch 14, and auxiliary switch 16 connected in series between bulb 12 and the positive terminal of battery 10. The power supply can include more than one battery preferably connected in series.

Preferably, auxiliary switch 16 is contained within face portion 4 and is a normally closed switch actuated by depressing auxiliary switch actuator 8. Preferably actuator 8 is a spring loaded plunger that projects through reflector 20 and translucent surface 18 and, when depressed, causes auxiliary switch 16 to open and break the electrical circuit. Thus, when a flashlight according to the invention is placed face down, that is, when translucent surface 18 of face portion 4 is placed in contact with a solid surface, the spring loaded plunger is depressed and the circuit is broken. As the flashlight is removed from such contact, the spring pushes the plunger outward and the circuit is completed, provided main switch 6 is in a closed position.

I claim:

1. A flashlight, comprising:

(a) a base portion adapted to be held in the hand and containing a source of electrical current, the source being adapted for electrical connection to a main switch and an auxiliary switch;

(b) a face portion protruding from the base portion, the face portion containing a light bulb adapted for electrical connection to a main switch and an auxiliary switch;

(c) an electrical circuit comprising in series the light bulb, a main switch, said source of electrical current, and an auxiliary switch, the auxiliary switch having mechanically attached thereto an actuator for altering the state of the auxiliary switch depending on the position of said face portion relative to a solid surface.

2. The flashlight according to claim 1, the actuator comprising a spring loaded plunger projecting from the auxiliary switch within the face portion to the exterior of the face portion and wherein the plunger is adapted for reciprocally depressing and projecting as the plunger is respectively forced into contact with a solid surface and released from contact with the solid surface.

3. A flashlight, comprising:

(a) a substantially cylindrical base portion adapted to be held in the hand and containing a source of electrical current, the source being adapted for electrical connection between a main switch and an auxiliary switch;

(b) a frusto-conical face portion attached to one end of the cylindrical base portion, the face portion containing a light bulb adapted for electrical connection to a main switch and to an auxiliary switch, a translucent surface forming the larger end of the frusto-conical face portion, a reflective surface between the light bulb and the base portion, and an auxiliary switch having a spring-loaded plunger mounted thereon; and (c) the plunger being a reciprocatingly translatable rod inserted through the reflective surface and through the translucent surface substantially perpendicular to the translucent surface, the rod projecting outside of the translucent surface by spring tension while the auxiliary switch is closed, and the rod retracting within the face portion as the translucent surface is forced against a solid surface, thereby opening the auxiliary switch.

4. In a flashlight comprising a base portion adapted to be held in the hand, a face portion, and an electrical current source switchably connected to a light bulb by a main switch, an auxiliary switch for disconnecting the current source from the bulb and reconnecting the current source and the bulb, the auxiliary switch comprising:

(a) a switch body located within the face portion of the flashlight, and (b) a spring loaded plunger having proximal and distal ends, the proximal end being attached to the switch body and the distal end projecting through a translucent surface defining a portion of a face portion of the flashlight, the plunger being reciprocatingly translatable as said distal end is forced into contact with a solid surface and as said distal end is removed from with a solid surface.

* * * * *